United States Patent [19]

Watts

[11] 4,281,612

[45] Aug. 4, 1981

[54] BOAT MOORING DEVICE

[76] Inventor: Homer A. Watts, Rte. 5, Box 712, Holly Grove Rd., Thomasville, N.C. 27360

[21] Appl. No.: 4,765

[22] Filed: Jan. 19, 1979

[51] Int. Cl.[3] ..... B63B 21/00

[52] U.S. Cl. ..... 114/230; 114/221 R; 294/118; 24/252 R; 81/417; 81/425 R

[58] Field of Search ..... 114/221 R, 230; 294/99 S, 118, 119; 81/321, 417, 418, 419, 425 R; 24/292 R

[56] References Cited

U.S. PATENT DOCUMENTS

| | | | |
|---|---|---|---|
| 2,506,839 | 5/1950 | Mead | 24/252 R |
| 2,531,987 | 11/1950 | Pilliod | 294/118 |
| 2,847,889 | 8/1958 | Cain | 81/417 X |
| 2,913,797 | 11/1959 | Hollis et al. | 114/230 X |
| 2,956,531 | 10/1960 | Banker | 114/230 |
| 2,983,243 | 5/1961 | Bowers et al. | 114/230 |
| 3,321,736 | 5/1967 | Flynn | 81/419 X |
| 3,403,431 | 10/1968 | Butler | 114/230 |

FOREIGN PATENT DOCUMENTS

| | | | |
|---|---|---|---|
| 346835 | 6/1920 | Fed. Rep. of Germany | 81/425 R |
| 757522 | 12/1933 | France | 81/417 |
| 7332871 | 4/1975 | France | 294/118 |

*Primary Examiner*—Trygve M. Blix

*Assistant Examiner*—D. W. Keen

*Attorney, Agent, or Firm*—Charles R. Rhodes; Judith G. Smith

[57] ABSTRACT

A pair of opposed arms extend in spaced parallel arrangement to each other, each of which arms include relatively short handle portions and relatively long gripping portions. The inner or opposed gripping edge of each arm includes a plurality of jagged teeth formed by relatively deep notches in the opposed edges of the arms. The teeth and notches are provided throughout substantially the entire gripping portion. The notches extend into the surface of the arms a distance of at least one-half inch. The arms are joined together by a connection about a pivot point positioned intermediate the handle portion and the gripping portion. A compression spring extends between the handle portions for normally biasing the gripping portions toward a closed position. One of the handles of the device receives one end of a tether which is attached at the other end to the boat. The extreme upper end of the gripping portion is provided with a beveled surface so that as the device is pushed into underbrush or undergrowth or onto a small branch, the arms are caused to spread, then clamps on the underbrush or undergrowth, whereupon the teeth grip the undergrowth tightly and provide a secure mooring for the boat.

1 Claim, 1 Drawing Figure

BOAT MOORING DEVICE

BACKGROUND OF THE INVENTION

With the advent of small fishing boats which are motored around the edges of ponds and lakes, it has become desirable to provide some type of mooring devices for such boats. A pier, dock, or even large limbs are not always available and therefore it would sometimes be advantageous to be able to temporarily attach the boat to smaller types of undergrowth, shrubs, small branches and the like which grow around the edges of such ponds and lakes. No such mooring device is available for attachment to such type of growth.

The prior art shows two types of mooring devices as exemplified by the U.S. Pat. No. 2,913,797 to Hollis et al and No. 2,956,531 to Banker. The Hollis ('797) patent is exemplary of a fastening device which is somewhat complex and in which a pair of piercing points 3 are moved into opposed arrangement behind a large limb or piling while a rope is caused to encircle the opposite side thereof. When the rope is pulled the piercing points at the extreme ends of the arms are impaled on the rear side of the object to which the device is applied. The Banker patent is directed to a mooring device having a solid arm arrangement and a pair of jaws 16 for mooring the craft to a stationary support such as a pier or other similar stationary object. Each jaw of the Banker patent is provided with one or more teeth at the extreme end of the jaws. In use, again only the tip of the jaws engage the object to which the boat is to be moored.

It is apparent that the devices shown by both of the aforementioned patents, while useful for their intended environments, would be of little or no use as far as a mooring device is concerned for boats traveling around the edge of ponds and lakes and where no substantially large limbs or piers were located. Therefore, there is needed some type of mooring device which may be useful in securing a boat to such type of growth as underbrush and undergrowth and small limbs and the like.

SUMMARY OF THE PRESENT INVENTION

The present invention, on the other hand, is directed to an improved mooring device which is useful not only on limbs, piers, and docks, but also in a different type of environment, i.e., that of the growth around ponds and lakes. Toward this end the device includes a pair of opposed arms, having a plurality of deep jagged teeth and notches extending along a substantial length of the arms, hereinafter called the gripping portion. The plurality of opposed jaws and deep jagged teeth ensure a good gripping effect on undergrowth, underbrush, or small limbs, whereas devices of the prior art might possibly not provide any substantial mooring at all. The arms are pivotally attached to each other and a compression spring or other biasing means between the handle portions thereof normally bias the arms toward a closed position. The extreme upper ends of the arms are provided with a downwardly and inwardly beveled surface so that as the device is pushed into the undergrowth, pressure exerted by a small limb or twig or branch into the area between the arms will cause the arms to spread slightly. The teeth encircle or grip the undergrowth and then the spring causes the arms to return to their closed position providing a good gripping action as the overlapping teeth grip down tightly on the object or objects to which the mooring is to be secured. A tether attached at one end to one of the handles of the device has the other end thereof secured to the boat so that it is temporarily maintained in a moored position while fishing or other activities are carried on therefrom. Also, of course, the gripping device may be operated to grip and release by squeezing the handles together in a normal fashion.

It is therefore an object of the present invention to provide an improved mooring device for small boats.

It is another object of the present invention to provide an improved mooring device of the type described in which a pair of opposed arms are provided with a pair of jaws lined with a plurality of intermeshing teeth and grooves for ensuring good gripping relation even in instances where the object to which the boat ismoored is nothing more than undergrowth and underbrush.

Other objects and a fuller understanding of the invention will become apparent from reading the following detailed description of a preferred embodiment in view of the accompanying drawings in which:

The sole FIGURE is a perspective view of the mooring or gripping device according to the present invention.

DETAILED DESCRIPTION OF PREFERRED EMBODIMENT

Figure 1:
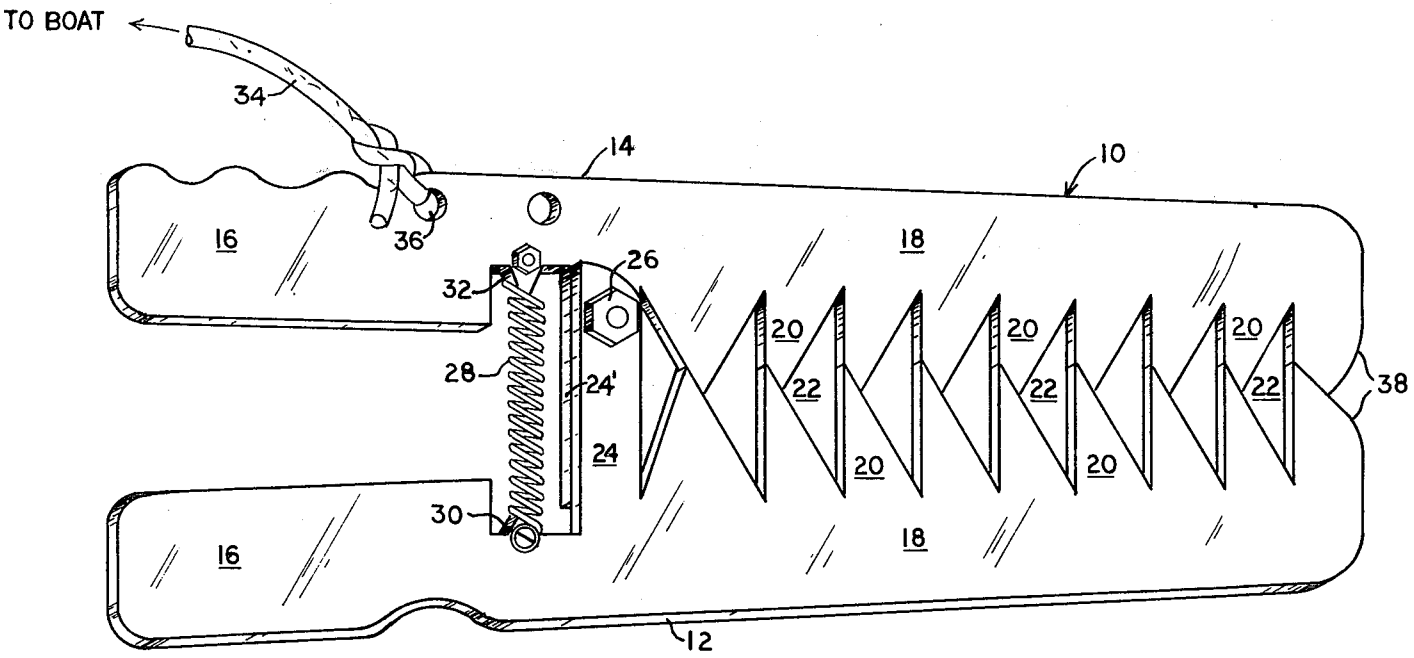

Turning now to the drawing, there is illustrated the mooring device 10 according to the present invention. A pair of opposed arms 12,14 extend longitudinally and in spaced parallel confronting arrangement to each other. Each arm 12,14 includes a relatively short lower handle portion 16 and a longer upper gripping portion 18. The gripping portion 18 of each arm is defined by a plurality of jagged teeth 20 alternating with relatively deep notches 22 along the opposed edges of each of said arms 12,14. These jagged teeth 20 and the interposed notches 22 extend substantially throughout the gripping portion 18 as illustrated in the drawing.

The aforementioned teeth 20 are formed by cutting away notches 22 to a depth at least one-half inch from the edge of the arm 12 and 14 toward the center thereof, so that a plurality of sharp gripping teeth 18 are provided with substantial space therebetween. Preferably notches 22 are so cut as to include a horizontal upper edge **22*a* and an included lower edge 22*b*. So arranged a better gripping action is realized because teeth 20** are then inclined to resist the pulling action of the boat.

In the area of arms 12 and 14 where the handles 16 merge into the gripping portions 18 there is provided a lateral extension 24,24'. A fastener such as a screw and nut 25,26 extends through cooperating openings in the extensions 24,24' to pivotally connect the two arms 12,14 together at a point intermediate the handle portion and the gripping portions. Further, a compression spring 28 has one end thereof attached to a protrusion 30 extending inwardly from arm 12 and the other end thereof attached to a protrusion 32 extending inwardly from arm 14 toward arm 12. Spring 28 normally urges the gripping portions of the jaws together.

A tether line 34 is tied or secured through an opening 36 in one of the handles 16, and the free end of the tether line 34 is attached to the boat in a conventional manner. The extreme upper ends of arms 12,14 are priovided with a downwardly and inwardly beveled surface 38. So arranged, as the mooring device 10 is pushed into undergrowth or underbrush or even against a limb or branch, the bevel surface 38 formed by the V-shaped area will be pushed apart causing the arms to spread until the branch has passed into the area between the opposed teeth 20 and notches 22. Once the branch or branches have passed into the gripping portion of compression spring 28 will urge the gripping portions of the arms back together to their normally closed position. The plurality of teeth 20 will then prevent removal of the fisherman opening the jaws. Also the mooring device may be operated by gripping the handles 16 and squeezing to spread the gripping portions 18 of the opposed arms 12,14 apart.

In operation, the long gripping portions 18 of the arms 12,14 formed by the plurality of teeth and notches 20,22 provide an improved mooring device over similar devices known before. The deep notches and teeth will tenaciously cling to whatever it is attached, especially in situations where used to secure a fishing boat to undergrowth and underbrush around the edge of lakes and ponds.

While a preferred embodiment of the invention has been described in detail hereinabove it is obvious that various changes and modifications might be made without departing from the scope of the invention which is set forth hereinbelow.

What is claimed is:

1. A mooring device to be utilized for mooring boats and like objects to the undergrowth and underbrush in the environment of lakes and ponds, said mooring device comprising a pair of opposed arms extending in spaced parallel arrangement to each other, each of said arms including relatively short lower handle portions and relatively long gripping portions, the gripping portion of each arm comprising a plurality of jagged teeth formed by deep notches, said teeth and notches provided in the opposed edges of said arms substantially throughout the gripping portion, said notches extending into the surfaces of said arms a distance of at least one-half inch, connecting means for joining said pair of arms about a pivot point positioned intermediate the handle portin and the gripping portion, compression spring means extending between said handle portions adjacent said connecting means for normally biasing said gripping portion toward a closed position, when in said closed position said teeth being in overlapped relationship, the extreme upper end of each of said opposed arms being provided with a beveled surface extending inwardly and downwardly for guiding branches and the like into the area between the opposed arms and causing said arms to spread as the mooring device is urged onto said branch, and a tether means connecting said boat and one of said handle portions.

* * * * *